United States Patent [19]

Potter

[11] 4,193,633

[45] Mar. 18, 1980

[54] CORE CHUCK

[75] Inventor: Blaine Potter, Sharon, Mass.

[73] Assignee: Double E Company, Inc., Brockton, Mass.

[21] Appl. No.: 861,451

[22] Filed: Dec. 16, 1977

[51] Int. Cl.[2] ..... B23B 31/40

[52] U.S. Cl. ..... 279/2 R; 242/72 R

[58] Field of Search ..... 279/2 R; 242/46.4, 72 R; 192/45.1, 54, 76

[56] References Cited

U.S. PATENT DOCUMENTS

| | | | |
|---|---|---|---|
| 1,122,627 | 12/1914 | Milne | 242/72 |
| 2,219,124 | 10/1940 | Bandy | 279/2 R |
| 3,963,250 | 6/1976 | Flagg | 279/2 R |

*Primary Examiner*—John Sipos

[57] ABSTRACT

A core chuck comprising an interior member having a longitudinal axis and n exterior camming surfaces, n jaws each having an interior camming surface, and 2n rollers radially intermediate the jaws and the interior member. Each of the rollers engages a camming surface defined either by the interior member or by a jaw, each camming surface is convex relative to the axis, and a roller cage maintains the circumferential spacing of the rollers.

14 Claims, 5 Drawing Figures

CORE CHUCK

BACKGROUND OF THE INVENTION

This invention relates to core chucks.

While there have been a number of chucks designed for use in processes where, for example, a roll of material must be held on a supporting shaft, most previous designs have suffered from one or more drawbacks. Prior U.S. Pat. Nos. 3,792,868 issued Feb. 19, 1975, 3,963,250 issued June 15, 1976, and 3,993,317 issued Nov. 23, 1976 provide improvements overcoming most of the prior problems. It has remained difficult, however, to design chucks that provide optimum performance, and can be used with variable size and over-size cores, under both light and heavy loads.

SUMMARY OF THE INVENTION

I have discovered that slippage between chuck and core and internal frictional resistance can be greatly reduced by providing camming surfaces on both the inside of the jaws and the exterior of the interior member; and that chucks so made greatly reduce the risks of jaw breakage, core damage and contamination generation, and automatically center the expandable jaws when retracted.

I have also discovered that a major difficulty in fully expanding the jaws of a chuck is that the pressure angle between a roller and a flat camming surface increases rapidly as the jaws move radially outward, and that the pressure angle can be held within acceptable limits without adversely affecting total theoretical expansion (and increasing practical available expansion) by providing camming surfaces that are outwardly convex relative to the chuck axis.

In its first aspect, the present invention according features a core chuck comprising an interior member having a longitudinal axis and n exterior camming surfaces, n jaws each having an interior camming surface, and 2n rollers radially intermediate the jaws and the interior member. Each of the rollers engages a camming surface defined either by the interior member or by a jaw, and a roller cage maintains the circumferential spacing of the rollers.

The second aspect features a chuck in which the camming surfaces defined by the interior member or expandable jaws and engaged by the rollers are convex outwardly relative to the longitudinal axis of the chuck.

In preferred embodiments the interior member defines three sets of camming surfaces each including a pair of camming surfaces extending circumferentially in opposite directions from a central null, each jaw includes two axially-spaced sets of camming surfaces, each camming surface has a constant rise per degree of rotation from its respective null, and the exterior surfaces of the jaws are smooth.

DESCRIPTION OF PREFERRED EMBODIMENT

The drawings show the preferred embodiment, which is then described. In the drawings.

Figure 1:
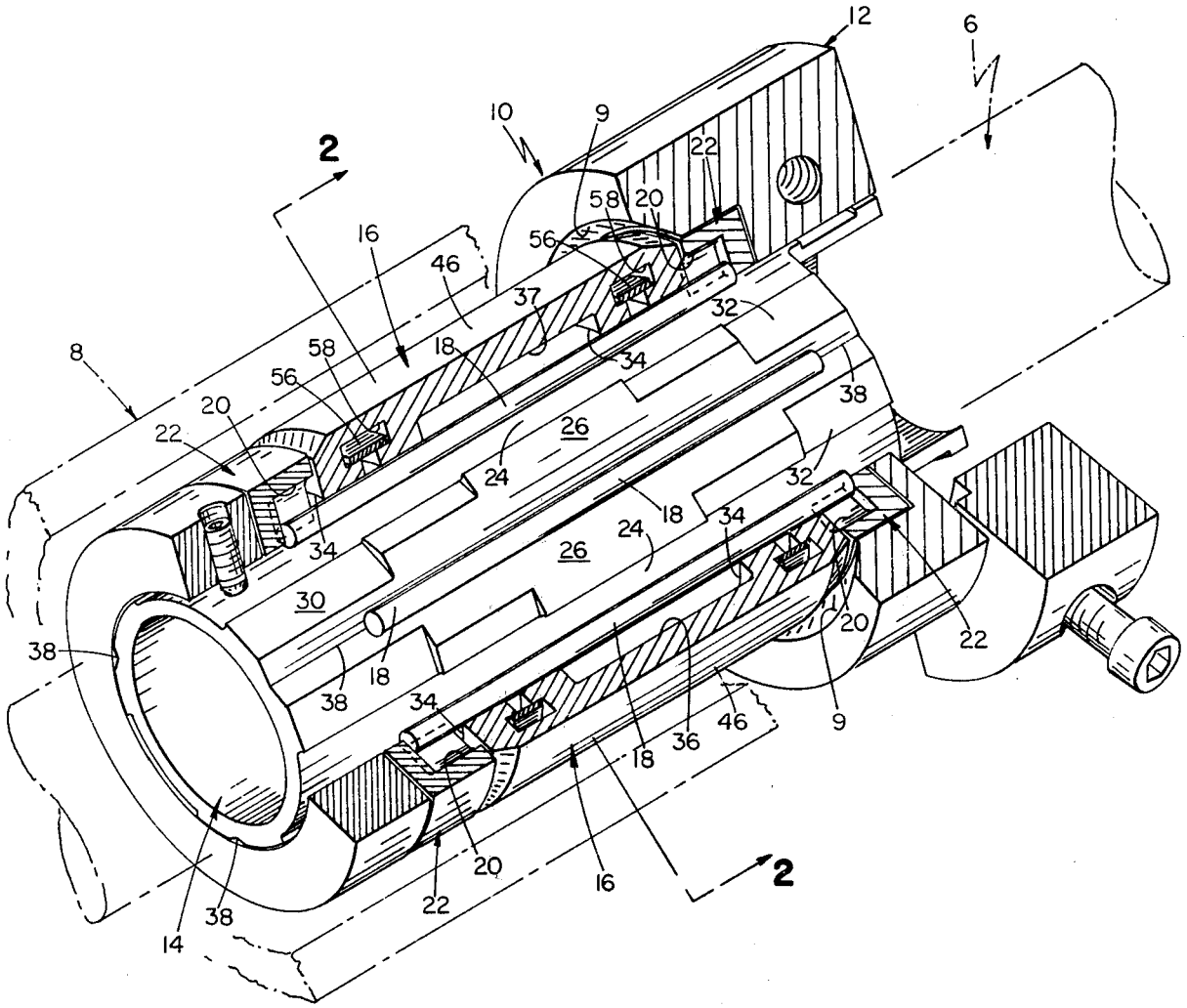
FIG. 1 is a perspective view, partially in section, of a core chuck constructed in accordance with the present invention.

The drawings illustrate a core chuck 10 of the type which is securable to a shaft 6 by means of a split ring 12 for supporting a roll of material wound about a core. While the various features of the present invention will be described with respect to the illustrated core chuck, it is to be understood that these features may be equally applicable to use on other forms of core chucks, such as the shaftmounted and turret type core chucks as described in prior U.S. Pat. Nos. 3,792,868; 3,963,250; and 3,993,317.

Referring to the drawings, chuck 10 includes an elongated inner member 14 surrounded by a series (e.g., three) of jaws 16, each extending circumferentially of inner member 14 through an arc of slightly less than 120°. Six rollers 18 are disposed radially between jaws 16 and inner member 14, with two rollers engaging each jaw. The ends of each roller 18 are disposed in recesses 20 in roller orienting rings 22 disposed about annular bearing surfaces defined by and adjacent opposite ends of member 14. The ring 22 and adjacent ends of jaws 16 nearest split ring 12 fit into a recess in the ring and are overlapped by a sloped circumferential stop surface 9. As thus far described, the construction of core chuck 10 is essentially the same as that of the core chucks described in the aforementioned prior U.S. Patents, which are here incorporated by reference.

According to the present invention, core chuck 10 includes a new and improved system for applying a radial outward force to jaws 16 in response to relative rotation between the jaws and interior member 14. In response to this rotation and force, the jaws are moved radially outwardly from their collapsed configuration (shown in FIG. 2 and in which the chuck may easily be inserted into core 8) and their expanded configuration (shown in FIG. 3 and in which the jaws firmly engage the inner surface of core 8). As shown most clearly in FIGS. 2 and 3, the means for applying the force includes radially pro-jecting camming surfaces 26, 34 provided, respectively, on the outer surface of member 14 and the inner surface of each of jaws 16.

Figure 4:
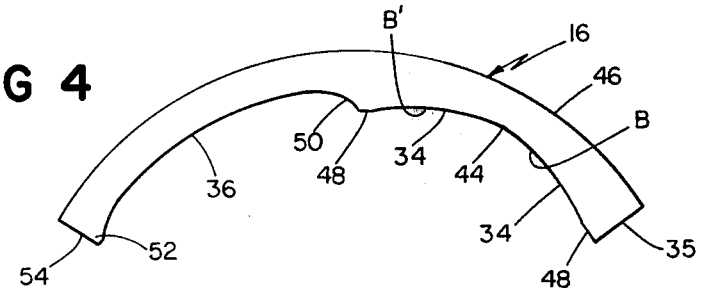
Figure 5:
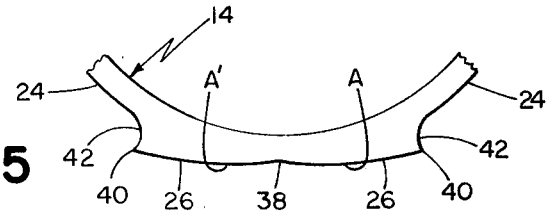
Figure 2:
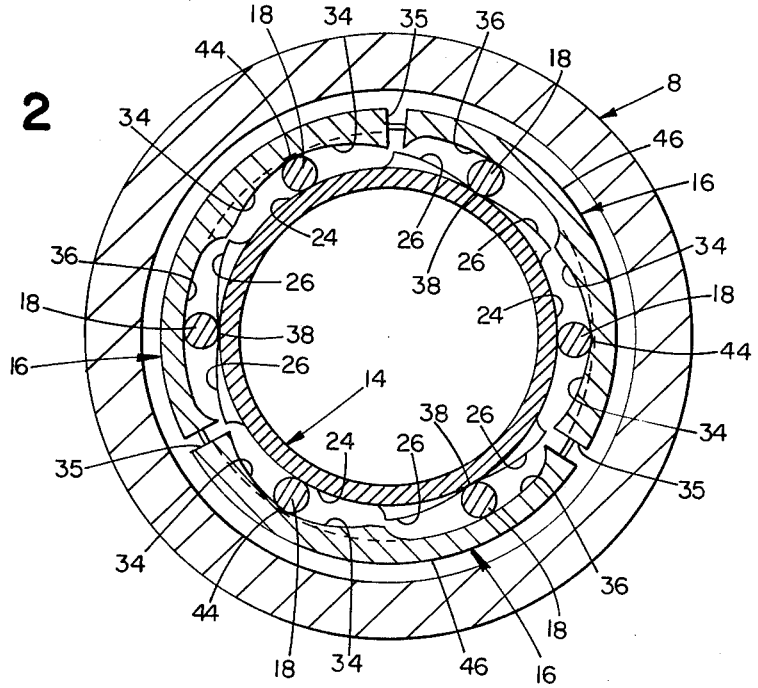
FIG. 2 is a sectional view taken at 2—2 of FIG. 1.
Figure 3:
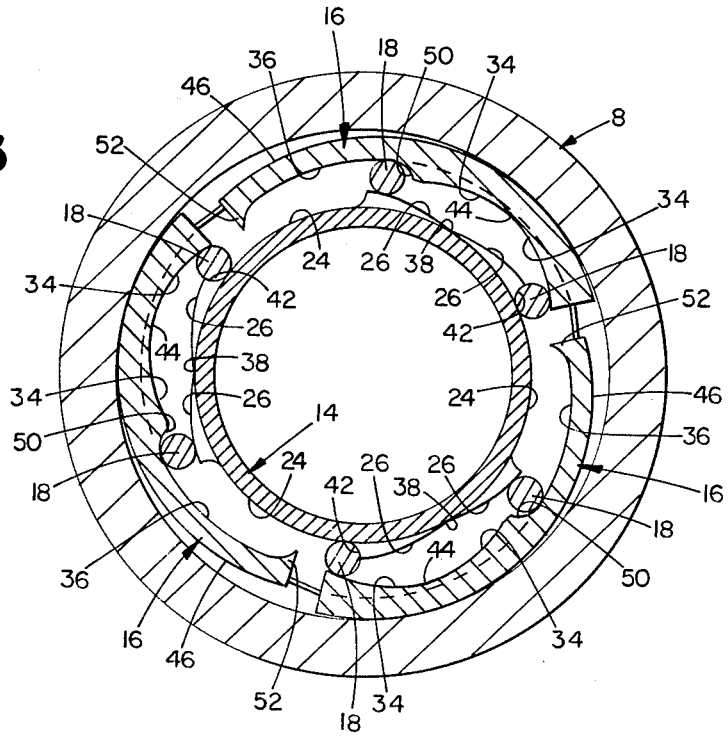
FIG. 3 is a sectional view similar to FIG. 2 but showing the chuck in its expanded configuration; and, FIGS. 4 and 5 are sectional views of portions of the chuck of FIG. 1, taken perpendicular to the axis thereof.

Interior member 14 defines three circumferentially spaced sets of radially outwardly projecting camming surfaces 26 and a cylindrical outer surface portion 24 located circumferentially between each set. Each of the outer surface portions 24 and sets of camming surfaces 26 subtends an arc of about 60°, and the three surface portions 24 and sets of camming surfaces 26 are regularly circumferentially spaced (as shown in FIGS. 2, 3 and 5). Each of jaws 16 includes two axially-spaced sets of radially-inwardly projecting camming surfaces 34. One set is positioned each end of the respective jaw, and each set subtends an arc of about 60° extending counterclockwise (as shown in FIGS. 2, 3 and 4) from the jaws longitudinally-extending edge 35. An inwardly-facing cylindrical surface portion 36 of radius greater than the minimum radius of camming surfaces, and as shown of radius substantially equal to the maximum radius of camming surfaces 34, extends circumferentially (counterclockwise as shown) from each set of camming surfaces 34 to the far longitudinal edge 54 of the jaw.

To provide clearance between the various camming surfaces, the portion of each jaw 16 axially intermediate the jaw's two sets of camming surfaces 34 defines a cylindrical surface 37 of radius substantially equal to that of surface portion 36. Similarly the axially-spaced portions of inner member camming surfaces 26 generally surrounded by jaw camming surfaces 34 and cylindrical surface portion 36 are reduced in maximum radius by removing the outer portions of the camming surfaces 26. The extent to which removal of interior member camming surfaces 26 and provision of jaw cylindrical surface 37 are required depends on the size of the particular chuck 10. In large chucks, surfaces 26 and 34 may extend axially the full length of jaws 16.

At opposite ends of camming surfaces 26, axially beyond the ends of jaws 16, interior member defines cylindrical outer surfaces 30, 32 respectively surrounded by and forming a slip fit with roller orienting rings 22. Depending on the configuration of the particular chuck, surfaces 30, 32 may be of radius either greater than (as shown) or equal to or smaller than that of cylindrical surface portions 24.

The configuration of camming surfaces 26 is shown most clearly in FIG. 5. As shown, each set of camming surfaces of member 14 includes two radially outwardly-facing camming surfaces 26 extending, circumferentially of member 14, in opposite directions from a central low point or null 38. Each surface 26 projects radially-outwardly from member 14 and is defined by a straight line moving, parallel to the axis of member 14, along a curve A (counterclockwise as shown) or A′ (clockwise) extending from null 38 to a maximum rise point 40 lying about 30° from null 38. Curves A, A′, and hence the two camming surfaces 26 of each set, are mirror images. Each curve A, A′ is such that camming surfaces 26 have a constant rise (radially-outwardly) per degree of rotation about the axis member 14. A rounded transition or stop 42 extends generally radially from each maximum rise point 40 to the cylindrical surface portion 24 between the rise point 40 and the adjacent set of camming surfaces 26.

Referring now to FIG. 4, each set of cam surfaces of each jaw 16 includes two radially inwardly facing and projecting camming surfaces 34 extending, circumferentially of the jaw 16, is defined by a straight line moving, parallel to the axis of the cylinders defining the jaw's outer surface 46 and cylindrical inner surface portion 36 of the respective jaw, along a curve B (clockwise as shown) B′ (counterclockwise) extending from null 44 to a minimum radius point 48 spaced about 30° from the null. As with camming surfaces 26, the two camming surfaces 34 of each jaw 16 are mirror images and provide a constant rise (radially inwardly) per degree of rotation about the axis of the cylinders defining surface 36 and the outer surface 46 of the jaw. A rounded transition 50 provides a stop at the side of the camming surface 34 adjacent the center of the respective jaw, and extends generally radially from minimum radius point 48 to cylindrical surface portion 36. A second radially inwardly projecting stop 52 is provided along the longitudinally extending edge 54 of each jaw 16 at the opposite side of the surface portion 44.

In the foregoing discussion, each camming surface 26, 34 has been described as extending through an arc of "about" 30°, and each set of camming surfaces as subtending an arc of "about" 60°. The nominal width of each set is 60°, and of each surface 30°. However, the actual width must be reduced somewhat to provide space and clearance for rollers 18. The amount of reduction depends on the size of the particular chuck and of its rollers. Typically, the arc subtended by a set of cam surfaces 26 will be in the range of 40°–55°, and that of a set of cam surfaces 34 in the range of 35°–50°, each surface of course subtending half the total arc.

Referring now to FIG. 1, a pair of split spring steel bands 56 are disposed in respective "T" shaped circumferential grooves 58 cut in the inner surface of jaws 16. One groove 58 is cut in the center of the inner jaw portions including the camming surfaces 34 at one end of jaws 16, and a second groove is provided at the other ends of the jaws. The cylindrical outer surfaces 46 of jaws 16 is smooth without serrations of the type heretofore normally required.

In operation, chuck 10 is inserted into a core 8 with jaws 16 in the fully retracted position, shown in FIG. 2, in which rollers 18 are positioned in nulls 38, 44. Of the two rollers 18 engaging each jaw, one engages null 38 of a set of cam surfaces 26 of member 14 and an inwardly-facing cylindrical surface portion 36 of the jaw 16, and the other engages null 44 of a set of cam surfaces 34 of the jaw 16 and an outwardly-facing cylindrical surface portion 24 of member 14. With the core 8 resting (often lightly) on the upper one or pair of jaws 16, the core 8 is then rotated relative to the core chuck 10. Jaws 16 move with the core, i.e., are rotated relative to inner member 14, and are displaced radially outwardly as the relative rotation causes rollers 18 to roll from nulls 38, 44 along respective ones of cam surfaces 26, 34. As they roll, the 60° spacing between adjacent rollers 18 is maintained by rings 22, which themselves rotate relative to member 14, and the recesses 20 in rings permit the rollers in contact with surfaces 26 to move radially outwardly.

Because each set of cam surfaces includes a pair of mirror image surfaces on opposite sides of a null, chuck 10 is fully reversable and is expanded by either clockwise or counterclockwise relative rotation of the jaws 16 and inner member 14. FIG. 3 illustrates the configuration of the chuck when it has fully expanded, e.g. jaws 16 have been moved radially outwardly the maximum possible distance, by rotation of the jaws 16 counterclockwise (as shown) relative to the inner member 14. As can be seen, each of the three rollers 18 in contact with a cam surface 26 has rolled on a cam surface 26 from its null 38 to adjacent its maximum rise point 40, and at the same time on a jaw cylindrical surface portion 36 from the center of the portion 36 to a stop 50. Similarly, each of the three rollers 18 in contact with a jaw cam surface 34 has rolled from a null 44 along the cam surface 34 to adjacent its minimum radius point 48, and simultaneously along an inner member cylindrical surface portion 24 into engagement with a stop 42. Further relative rotation is prevented by the stops 50, 42; and further expansion by split ring surface 9. As should be clear, relative rotation of jaws 16 and inner member 14 in the other direction would expand the jaws from their FIG. 2 configuration by causing rollers 18 to roll along the other cam surface of each respective set, until, with the jaws fully expanded, further rolling is prevented by stops 52 and the stops 42 on the other side of each set of cam surfaces 26. In either case, the jaws 16 may be retracted simply by reversing the direction of relative rotation from that used to expand them. When so released, the jaws tend automatically to return to the FIG. 2 configuration, in which each roller 18 rests in a respective null 38, 44.

In other embodiments, the jaws and interior members may include twice as many sets of cam surfaces so that each roller engages a cam surface on both the interior member and a jaw, the cam surfaces of each set may not be mirror images, and if reversibility is not required each set may include only a single cam surface. These and other embodiments will be within the scope of the following claims.

What is claimed is:

1. In a core chuck comprising an interior member having a longitudinal axis and n exterior circumferentially spaced camming surfaces each defined by moving a straight line which extends parallel to the axis simultaneously radially outwardly and circumferentially of the member, n jaws generally surrounding the interior member, 2n rollers radially intermediate the jaws and the interior member with two of the rollers engaging each of the jaws, and means for maintaining the relative circumferential spacing of the rollers and for permitting at least some of the rollers to move radially relative to the interior member, that improvement wherein:

an interior camming surface projects radially inwardly from each of said jaws, each of said interior camming surfaces being defined by moving a straight line which extends parallel to the axis of the interior member simultaneously radially inwardly of the jaw and circumferentially of the member, one of the two rollers engaging each of the jaws engages the interior camming surface thereof, the other of the two rollers engaging each of the jaws engages an exterior camming surface of the interior member, and relative rotation of the jaws and interior member about the axis of the interior member causes the rollers to move along camming surfaces in a direction circumferentially of the jaws and member and move the jaws radially relative to the member.

2. The core chuck of claim 1 wherein each jaw defines a set of said interior camming surfaces, said interior member defines n sets of said exterior camming surfaces, each of said sets subtends an arc of about 360/2n degrees and includes a null and a pair of camming surfaces extending circumferentially of said interior member in opposite directions from said null, and the camming surfaces of each said pair are substantial mirror images.

3. The core chuck of claim 2 wherein each of said jaws has a pair of circumferentially spaced longitudinal edges and subtends an arc of about 360/n degrees between said longitudinal edges thereof, and the interior camming surface of each jaw has a maximum lift point adjacent a longitudinal edge of said each jaw.

4. The core chuck of claim 1 wherein each of said jaws includes a generally cylindrical surface portion spaced circumferentially of the interior camming surface of said each jaw, said interior member defines n circumferentially-spaced cylindrical surface portions each intermediate a pair of said exterior camming surfaces, and each of said rollers engages a camming surface defined by one of said member and a said jaw and a cylindrical surface portion defined by the other of said member of a said jaw.

5. The core chuck of claim 1 wherein each of said jaws includes a pair of said interior camming surfaces spaced axially from each other, and said exterior camming surfaces of said interior member are axially intermediate said interior camming surfaces.

6. The core chuck of claim 1 wherein each of said jaws has a pair of circumferentially spaced longitudinal edges, subtends an arc of about 360/n degrees between said longitudinal edges thereof, and defines a set of said interior camming surfaces extending circumferentially through an arc of about 360/2n degrees from one of said longitudinal edges thereof and a cylindrical surface portion extending circumferentially through an arc of about 360/2n degrees from the other of said longitudinal edges thereof, said interior member includes n circumferentially spaced sets of exterior camming surfaces and a cylindrical surface portion intermediate each adjacent pair of said sets, each of said sets and said cylindrical surface portions of said interior member extending through an arc of about 360/n degrees, and each of said sets includes a null and a pair of camming surfaces extending circumferentially in opposite directions from said null.

7. The core chuck of claim 6 wherein each of said jaws includes radially inwardly projecting stops adjacent the circumferentially spaced edges of said cylindrical surface portion thereof, and said interior member defines radially-outwardly projecting stops adjacent the circumferentially spaced edges of each of said cylindrical surface portions thereof.

8. The core chuck of claim 6 wherein n is three.

9. The core chuck of claim 6 wherein the exterior surfaces of said jaws are substantially smooth.

10. In a core chuck comprising an interior member having a longitudinal axis, n jaws generally surrounding the interior member, a plurality of circumferentially-spaced rollers radially intermediate the jaws and the interior member, and a plurality of camming surfaces projecting radially inwardly from said jaws and radially outwardly from said interior member, said rollers engaging said camming surfaces, that improvement wherein:

each of said camming surfaces is defined by moving a straight line which extends parallel to the axis of the interior member simultaneously radially and circumferentially such that the surface thus defined is convex outwardly relative to said longitudinal axis;

each of said jaws defines at least one said interior camming surface; and, said interior member defines at least n circumferentially spaced said exterior camming surfaces.

11. The core chuck of claim 10 wherein said interior member defines 2n circumferentially spaced said exterior camming surfaces arranged in n sets each including a null and a pair of said exterior camming surfaces extending in opposite directions from said null.

12. The core chuck of claim 14 wherein each of said jaws includes a pair of inwardly facing camming surfaces.

13. The core chuck of claim 10 including means for maintaining the relative circumferential spacing of said rollers and for permitting at least some of said rollers to move radially relative to said interior members.

14. The core chuck of claim 10 including three of said jaws, six of said rollers, and at least six of said camming surfaces.

* * * * *

UNITED STATES PATENT AND TRADEMARK OFFICE

CERTIFICATE OF CORRECTION

PATENT NO. : 4,193,633

DATED : March 18, 1980

INVENTOR(S) : Blaine Potter

It is certified that error appears in the above-identified patent and that said Letters Patent are hereby corrected as shown below:

Column 6, line 55 "claim 14" should be --claim 10--.

Signed and Sealed this

*Twenty-fourth* Day of *June 1980*

[SEAL]

*Attest:*

SIDNEY A. DIAMOND

*Attesting Officer*

*Commissioner of Patents and Trademarks*